United States Patent [19]

Oakes

[11] Patent Number: 4,568,477

[45] Date of Patent: Feb. 4, 1986

[54] DETERGENT BLEACH COMPOSITIONS

[75] Inventor: John Oakes, Winsford, Great Britain

[73] Assignee: Lever Brothers Company, New York, N.Y.

[21] Appl. No.: 678,319

[22] Filed: Dec. 5, 1984

[30] Foreign Application Priority Data

Dec. 6, 1983 [GB] United Kingdom ..... 8332485
Dec. 6, 1983 [GB] United Kingdom ..... 8332487

[51] Int. Cl.[4] ..... C11D 7/18; C11D 3/04

[52] U.S. Cl. ..... 252/99; 252/95; 252/102; 252/186.41; 252/135; 8/103; 8/111

[58] Field of Search ..... 252/95, 99, 102, 186.41, 252/135; 8/103, 111

[56] References Cited

U.S. PATENT DOCUMENTS

| | | | |
|---|---|---|---|
| 3,156,654 | 11/1964 | Konecny et al. | 252/95 |
| 3,372,125 | 3/1968 | Hill et al. | 252/95 |
| 3,398,096 | 8/1968 | Das et al. | 252/95 |
| 3,532,634 | 10/1970 | Woods | 252/95 |
| 4,144,226 | 3/1979 | Crutchfield et al. | 528/231 |
| 4,146,495 | 3/1979 | Crutchfield et al. | 252/174.23 |
| 4,208,295 | 6/1980 | Sai et al. | 252/94 |
| 4,430,243 | 2/1984 | Bragg | 252/91 |
| 4,478,733 | 10/1984 | Oakes | 252/99 |
| 4,481,129 | 11/1984 | Oakes | 252/186.41 |
| 4,488,980 | 12/1984 | Oakes | 252/99 |

FOREIGN PATENT DOCUMENTS

| | | |
|---|---|---|
| 25608 | 3/1981 | European Pat. Off. . |
| 72166 | 2/1983 | European Pat. Off. . |
| 82563 | 6/1983 | European Pat. Off. . |

*Primary Examiner*—Prince E. Willis
*Attorney, Agent, or Firm*—Milton L. Honig; James J. Farrell

[57] ABSTRACT

Activated detergent bleach composition comprising a peroxide compound bleach, a manganese catalyst and a detergency builder composition comprising:

(i) a mixture of water-soluble, non-phosphorus organic sequestering builder and an alkaline buffer in a weight ratio of organic sequestering builder to alkaline buffer of from 10:1 to 1:60; or (ii) a mixture of alkali metal triphosphate and alkali metal pyrophosphate, the latter being present in at least 5% by weight of the former, but not more than 15% by weight of the total composition, the composition having a pH under use conditions of 9.5 to 12.0.

The compositions are suitable for bleaching and cleaning fabrics at lower temperatures.

5 Claims, No Drawings

DETERGENT BLEACH COMPOSITIONS

This invention relates to activated detergent bleach compositions comprising a peroxide compound bleach and a manganese catalyst suitable for the bleaching and cleaning of fabrics at lower temperatures. The peroxide compound bleach used herein includes hydrogen peroxide and hydrogen peroxide adducts, e.g. inorganic persalts which liberate hydrogen peroxide in aqueous solutions such as the water-soluble perborates, percarbonates, perphosphates, persilicates and the like.

In European Patent Application No. 0082563 there are described the outstanding properties of manganese with respect to consistently enhancing the bleach performance of peroxide compounds at substantially all washing temperatures, especially at lower temperatures, if used in combination with a carbonate compound which delivers carbonate ions ($CO_3^{2-}$) in aqueous media.

It has now been found that a consistent activation of peroxide compounds by manganese, so as to render them usable for bleaching at lower temperatures, e.g. from 20° to 60° C., can also be achieved if used with an alkaline detergent composition containing as main detergency builders:

(i) a mixture of a water-soluble, non-phosphorus organic sequestering builder and an alkaline buffer, selected from the group consisting of alkali metal orthophosphates, alkali metal silicates and alkali metal borates and mixtures thereof, in a weight ratio of organic sequestering builder to alkaline buffer of from 10:1 to 1:60, or (ii) a mixture of an alkali metal triphosphate and an alkali metal pyrophosphate, the latter being present in at least 5% by weight of the former but not more than 15% by weight of the total composition, whilst maintaining the pH of the composition under use conditions at a level of 9.5 to 12.

The organic sequestering builder

Useful water-soluble, organic sequestering builders in the present compositions are, for example, the alkalimetal, ammonium and substituted ammonium polyacetates, carboxylates, polycarboxylates, polyacetylcarboxylates and polyhydroxysulphonates. Specific examples of the polyacetate and polycarboxylate builder salts include sodium, potassium, lithium, ammonium and substituted ammonium salts of ethylene diamine tetraacetic acid, nitrilotriacetic acid, oxysuccinic acid, mellitic acid, benzene polycarboxylic acids, citric acid and the polyacetalcarboxylates, disclosed in U.S. Pat. No. 4,144,226 and 4,146,495, which are included herein by reference.

Highly preferred non-phosphorous sequestering builder materials herein include sodium citrate, sodium nitrilotriacetate, sodium oxydisuccinate, sodium mellitate, and the polyacetalcarboxylates, disclosed in U.S. Pat. Nos. 4,144,226 and 4,144,495.

Other highly preferred sequestering builders are the polycarboxylate builders. Examples of such materials include the water-soluble salts of the homo- and copolymers of aliphatic carboxylic acids such as maleic acid, itaconic acid, mesaconic acid, fumaric acid, aconitic acid, citraconic acid, methylenemalonic acid, 1,1,2,2-ethane tetracarboxylic acid, dihydroxy tartaric acid, and keto-malonic acid.

Additional preferred organic sequestering builders herein include the water-soluble salts, especially the sodium and potassium salts of carboxy methyloxymalonates, carboxymethyloxysuccinate, cis-cyclohexanehexacarboxylate, cis-cyclopentanetetracarboxylate, and phloroglucino-trisulphonate.

The alkaline buffer

A preferred alkalimetal orthophosphate is sodium orthophosphate, i.e. trisodium orthophosphate of the formula $Na_3PO_4$.

The alkalimetal silicate may be any alkaline silicates, preferably alkaline sodium silicates, of which the ratio of $Na_2O:SiO_2$ may vary from 1:35 to 2:1.

Examples of alkalimetal borates are sodium tetraborate, sodium metaborate and sodium pentaborate. Since sodium metaborate is produced by sodium perborate on liberation of hydrogen peroxide in solution, it should be appreciated that sodium perborate may also be used as a source of alkali metal borate.

The above-described organic sequestering builder and the alkaline builder used according to the invention should be present in a weight ratio of from 10:1 to 1:60.

Preferred alkali metal triphosphate is sodium triphosphate and preferred alkali metal pyrophosphate is sodium pyrophosphate. Preferably the alkali metal pyrophosphate will be present in an amount of more than 20% by weight of the alkali metal triphosphate builder, though it should not be present at a level of more than 15%, preferably not more than 10% by weight of the total composition.

The manganese used according to the present invention can be derived from any manganese (II) salt, such as manganous sulphate and manganous chloride, or any other manganese compound which delivers manganese (II) ions in aqueous solution.

The optimum levels of manganese (II) ions—$Mn^{2+}$—in the wash/bleach solution are dependent upon the formulation in which the manganese as bleach catalyst is applied. In terms of parts per million (ppm) of manganese (II) ions in the wash/bleach solution a suitable range will generally be from 0.1 to 50 ppm, preferably from 0.5–25 ppm.

These correspond roughly to a manganese (II) metal content in a bleach or detergent composition of about 0.002–2.5% by weight, preferably from 0.01–1.0% by weight of the composition.

The level of peroxide compound bleach, e.g. sodium perborate, sodium percarbonate, sodium persilicate, sodium perpyrophosphate and urea peroxide, will normally be within the range of 5 to 50%, preferably from 10 to 35% by weight of the total composition.

Accordingly the invention provides an alkaline built detergent bleach composition comprising a peroxide compound and a manganese compound, characterized in that it contains as main detergency builders:

(i) a mixture of a water-soluble, non-phosphorus organic sequestering builder and an alkaline buffer, selected from the group consisting of alkali metal orthophosphates, alkali metal silicates and alkali metal borates and mixtures thereof, in a weight ratio of organic sequestering builder to alkaline buffer of from 10:1 to 1:60; or (ii) a mixture of an alkali metal triphosphate and an alkali metal pyrophosphate, the latter being present in at least 5% by weight of the former but not more than 15% by weight of the total composition;

said composition having a pH under use conditions of 9.5 to 12.0.

The sequestering organic builder and the specific alkaline buffer may be used as the sole builders in the composition of the invention, but they can also be used as main builders in admixture with other principal or non-principal builders in minor amounts, such as polyphosphates and the like, e.g. sodium and potassium triphosphates or pyrophosphates.

Consequently, the total amount of sequestrant organic builder and alkaline buffer in the composition of the invention can be varied as desired for providing the required builder capacity of the composition with or without the presence of other builders.

In practice the composition of the invention may comprise from about 5 to 80% by weight, preferably 10–60% by weight of the sequestering organic builder-/alkaline buffer mixture in a ratio by weight of sequestering organic builder to alkaline buffer of from 10:1 to 1:60, preferably from 5:1 to 1:30, and particularly from 1:1 to 1:30.

Likewise the alkali metal triphoshate/alkali metal pyrophosphate builder mixture may be used as the sole builder in the composition of the invention, or it can be used as main builder with other principal or non-principal builders in minor amounts, such as the other condensed phosphates, e.g. sodium hexametaphosphate and the many known water-soluble organic sequestrant builders.

Useful water-soluble, organic sequestering builders in the present compositions are, for example, the alkali metal, ammonium and substituted ammonium polyacetates, carboxylates, polycarboxylates, polyacetylcarboxylates and polyhydroxysulphonates. Specific examples of the polyacetate and polycarboxylate builder salts include sodium, potassium, lithium, ammonium and substituted ammonium salts of ethylene diamine tetraacetic acid, nitrilotriacetic acid, oxysuccinic acid, mellitic acid, benzene polycarboxylic acids, citric acid and the polyacetalcarboxylates disclosed in U.S. Pat. Nos. 4,144,226 and 4,146,495, which are included herein as reference.

Consequently, the total amount of alkali metal triphosphate and alkali metal pyrophosphate builders in the composition of the invention can be varied as desired for providing the required builder capacity of the composition with or without the other builders.

Also sodium carbonate in minor amounts may be used as additional builder without deviating from the present inventive concept.

In practice the composition of the invention may comprise from about 5 to 80% by weight, preferably 10–60% by weight of the alkali metal triphosphate/alkali metal pyrophosphate builder mixture.

Any manganese (II) salt can in principle be employed, such as for example manganous sulphate ($Mn.So_4$), either in its anhydrous form or as hydrated salt, manganous chloride ($MnCl_2$), anhydrous or hydrated, and the like.

The detergent bleach composition of the invention usually contains a surface active agent, generally in an amount of from about 2% to 50% by weight, preferably from 5–30% by weight. The surface active agent can be anionic, nonionic, zwitterionic or cationic in nature or mixtures of such agents.

Preferred anionic non-soap surfactants are water-soluble salts of alkylbenzene sulphonate, alkyl sulphate, alkylpolyethoxyether sulphate, paraffin sulphonate, alpha-olefin sulphonate, alpha-sulfocarboxylates and their esters, alkylglycerylethersulphonate, fatty acid monoglyceride-sulphates and -sulphonates, alkylphenolpolyethoxy ethersulphate, 2-acyloxy-alkane-1-sulphonate, and beta-alkyloxy alkanesulphonate. Soaps are also preferred anionic surfactants.

Especially preferred are alkylbenzenesulphonates with about 9 to about 15 carbon atoms in a linear or branched alkyl chain, more especially about 11 to about 13 carbon atoms; alkylsulphates with about 8 to about 22 carbon atoms in the alkyl chain, more especially from about 12 to about 18 carbon atoms; alkylpolyethoxy ethersulphates with about 10 to about 18 carbon atoms in the alkyl chain and an average of about 1 to about 12 —$CH_2CH_2O$-groups per molecule, especially about 10 to about 16 carbon atoms in the alkyl chain and an average of about 1 to about 6 —$CH_2CH_2O$-groups per molecule; linear paraffin sulphonates with about 8 to about 24 carbon atoms, more especially from about 14 to about 18 carbon atoms and alpha-olefin sulphonates with about 10 to about 24 carbons atoms, more especially about 14 to about 16 carbon atoms; and soaps having from 8 to 24, especially 12 to 18 carbon atoms.

Water-solubility can be achieved by using alkali metal, ammonium, or alkanolamine cations; sodium is preferred. Magnesium and calcium may be preferred cations under certain circumstances.

Preferred nonionic surfactants are water-soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation product of 1 to 30 moles of ethylene oxide with 1 mol of branched or straight chain, primary or secondary aliphatic alcohol having from about 8 to about 22 carbon atoms; more especially 1 to 6 moles of ethylene oxide condensed with 1 mol of straight or branched chain, primary or secondary aliphatic alcohol having from about 10 to about 16 carbon atoms; certain species of poly-ethoxy alcohol are commercially available under the trade-names of "Neodol" ®, "Synperonic" ® and "Tergitol" ®.

Preferred zwitterionic surfactants are water-soluble derivatives of aliphatic quaternary ammonium, phosphonium and sulphonium cationic compounds in which the aliphatic moieties can be straight or branched, and wherein one of the aliphatic substituents contains from about 8 to 18 carbon atoms and one contains an anionic water-solubilizing group, especially alkyldimethylpropanesulphonates and alkyldimethyl-ammoniohydroxypropane-sulphonates wherein the alkyl group in both types contains from about 1 to 18 carbon atoms.

Preferred cationic surface active agents include the quaternary ammonium compounds, e.g. cetyltrimethylammonium-bromide or -chloride and distearyldimethylammonium-bromide or -chloride, and the fatty alkyl amines.

A typical listing of the classes and species of surfactants useful in this invention appear in the books "Surface Active Agents", Vol. I, by Schwartz & Perry (Interscience 1949) and "Surface Active Agents", Vol. II by Schwarz, Perry and Berch (Interscience 1958), the disclosures of which are incorporated herein by reference. The listing, and the foregoing recitation of specific surfactant compounds and mixtures which can be used in the specific surfactant compounds and mixtures which can be used in the instant compositions, are representative but are not intended to be limiting.

In addition thereto the compositions of the invention may contain any of the conventional components and/or adjuncts usable in fabric washing compositions.

As such can be named, for instance, other conventional or non-conventional detergency builders, inorganic or organic, which can be used together with the essential builder mixture of the invention up to a total builder level of about 80% by weight. Usually the amount of such other builders, if present in the context of this invention, will be at a level of less than 10% by weight of the total composition.

Non-conventional builders are for example the ion-exchange builders such as zeolites, which may also be added without deviating from the present inventive concept.

Other components/adjuncts commonly used in detergent compositions are for example soil-suspending agents and anti-redeposition aids such as water-soluble salts of carboxymethylcellulose, carboxyhydroxymethylcellulose, copolymers of maleic anhydride and vinyl ethers, copolymers of maleic anhydride and acrylic acid, and polyethylene glycols having a molecular weight of about 400 to 10.000. These can be used at levels of about 0.5% to about 10% by weight. Dyes, pigments, optical brighteners, perfumes, anti-caking agents, suds control agents, enzymes and fillers can also be added in varying minor amounts as desired.

The detergent compositions of the invention are preferably presented in free-flowing particulate, e.g. powdered or granular form, and can be produced by any of the techniques commonly employed in the manufacture of such detergent compositions, but preferably by slurry-making and spray-drying processes to form a detergent base powder to which the heat-sensitive ingredients, including the peroxide compound and optionally some other ingredients as desired, are added. It is preferred that the process used to form the compositions should result in a product having a moisture content of not more than about 12%, more preferably from about 4% to about 10% by weight. The manganese compound may be added to the compositions as part of the aqueous slurry, which is then dried to a particulate detergent powder, or preferably as a dry particulate adjunct mixed in with the detergent base powder.

EXAMPLE I

The following particulate detergent composition was prepared:

| Composition I | % by weight |
|---|---|
| Sodium $C_{12}$—alkylbenzene sulphonate | 15.0 |
| Sodium citrate | 20.0 |
| Trisodium orthophosphate | 15.0 |
| Sodium perborate tetrahydrate | 25.0 |

Remainder sodium sulphate + water and optionally alkaline agent up to 100% to give a solution pH (5 g/l) of 10.1

To this powder manganous sulphate was added in varying amounts and the compositions were tested at a dosage of 5 g/l in a 30 minutes isothermal wash at 40° C. in demineralised water.

The bleaching results obtained on tea-stained test cloths measured as reflectance (ΔR) were as follows:

TABLE 1

| $[Mn^{2+}]$ ppm in solution | % by weight in product | ΔR (reflectance value) |
|---|---|---|
| 0 | 0 | 7.0 |
| 0.25 | 0.005 | 9.3 |
| 0.5 | 0.01 | 11.5 |
| 0.75 | 0.015 | 13.3 |
| 1.0 | 0.02 | 13.7 |
| 2.0 | 0.04 | 13.2 |

Bleach activation is clearly shown with manganese at a level of from 0.005% by weight in the product, improving consistently with increasing levels of manganese.

EXAMPLE II

The following particulate detergent bleach compositions were prepared:

| Compositions | % by weight II | II[1] |
|---|---|---|
| Sodium $C_{12}$ alkyl benzene sulphonate | 15.0 | 15.0 |
| Sodium citrate | 20.0 | — |
| Sodium metaborate | 10.0 | 10.0 |
| Sodium perborate tetrahydrate | 25.0 | 25.0 |
| Manganous sulphate (as $Mn^{2+}$) | 0.04 | 0.04 |
| Sodium sulphate + water, up to 100%. | | |
| Solution pH of composition at 5 g/l | 10.1 | 10.1 |

These compositions were tested at a dosage of 5 g/l in a 30 minutes Tergotometer isothermal wash at 40° C. in deminearlized water. The bleaching results obtained on standard tea-stained test cloths, measured as reflectance value (ΔR), were as follows:

Composition II of the invention ΔR=7.0

Composition II[1] outside the invention ΔR=1.5

EXAMPLE III

The following particulate detergent composition was prepared:

| Composition | III % by weight |
|---|---|
| $C_{13}$—$C_{15}$ fatty alcohol/7 ethylene oxide | 15.0 |
| Sodium nitrilotriacetate | 4.0 |
| Sodium orthophosphate | 11.0 |
| Sodium perborate tetrahydrate | 25.0 |
| Sodium sulphate + water up to 100%. | |
| 5 g/l solution pH | 10.1 |

To this powder, manganese sulphate was added in varying amounts and the compositions were tested at a dosage of 5 g/l in a 30 minutes Tergotometer isothermal wash at 40° C. in demineralized water.

The bleaching results on standard tea-stained test cloths measured as reflectance value (ΔR) were as follows:

TABLE 2

| $[Mn^{2+}]$ ppm. in solution | % by weight in product | ΔR reflectance value |
|---|---|---|
| 0 | 0 | 4.0 |
| 2 | 0.04 | 6.0 |
| 5 | 0.10 | 8.5 |
| 8 | 0.16 | 9.5 |

EXAMPLE IV

The following detergent compositions were prepared containing a builder mixture of sodium nitrilotriacetate (NTA) and sodium orthophosphate at various ratios.

| Compositions | % by weight |
|---|---|
| Sodium $C_{12}$ —alkyl benzene sulphonate | 15.0 |
| NTA/sodium orthophosphate | 15.0 |
| Sodium perborate | 25.0 |
| Manganese sulphate (% as $Mn^{2+}$) | 0.2 |
| Sodium sulphate + water up to 100% | |

These compositions were tested at a dosage of 5 g/l in a 30 minutes' isothermal wash at 40° C. in deminearlized water.

The bleaching effects obtained on tea-stained test cloths, measured as ΔR (reflectance value) are shown in the following Table 3.

TABLE 3

| % NTA | % Ortho | ΔR (reflectance) |
|---|---|---|
| 0 | 15 | 3.0 |
| 2 | 13 | 11.0 |
| 4 | 11 | 10.0 |
| 5 | 10 | 7.0 |
| 15 | 0 | 2.0 |

The beneficial effect of the combination of NTA and sodium orthophosphate on the catalytic action of manganese is clearly seen from the above Table.

EXAMPLE V

The following particulate detergent composition was prepared with manganese (II) as manganese sulphate added at various levels.

| Composition | % by weight |
|---|---|
| Sodium $C_{12}$—alkyl benzene sulphonate | 15.0 |
| Sodium citrate | 20.0 |
| $Na_2SiO_3$ | 9.6 |
| Sodium perborate tetrahydrate | 25.0 |
| Manganous sulphate | + |
| Sodium sulphate + water up to 100% | |

pH (5 g/l) solution = 10.2

These compositions were tested at a dosage of 5 g/l in a 30 minutes' isothermal wash at 40° C. in demineralized water.

The bleaching effects obtained on tea-stained test cloths, measured as ΔR (reflectance), were as follows:

TABLE 4

| $[Mn^{2+}]$ ppm. in solution | % by weight in product | ΔR (reflectance) |
|---|---|---|
| 0 | 0 | 7.5 |
| 0.5 | 0.01 | 13.7 |
| 0.7 | 0.014 | 14.7 |
| 0.85 | 0.017 | 14.8 |
| 1.0 | 0.02 | 14.9 |
| 1.5 | 0.03 | 14.8 |
| 2.0 | 0.04 | 14.5 |

EXAMPLE VI

The following particulate deterent compositions were prepared:

| Composition | % by weight |
|---|---|
| Sodium $C_{12}$ alkylbenzene sulphonate | 15.0 |
| Sodium triphosphate | 10.0 |
| Sodium pyrophosphate | 10.0 |
| Sodium perborate | 25.0 |
| Manganous sulphate [as $Mn^{2+}$] | 0.04 |

Alkaline material/sodium sulphate/moisture up to 100%.

The amount of alkaline material in this powder was varied to give pH (at 5 g/l dosage) varying from 9.25 to 11.2; the compositions were then tested at a dosage of 5 g/l in a 30 minutes' isothermal wash at 40° C. in water of 24° French Hardness.

The bleaching results obtained on tea-stained test cloths, measured as reflectance value (ΔR), are shown in the Table 5 below. A composition without manganese was used as control and comparison.

TABLE 5

| pH | ΔR − Mn | ΔR + Mn |
|---|---|---|
| 9.25 | 2.0 | 2.6 |
| 9.5 | 2.3 | 4.6 |
| 9.8 | 3.2 | 10.4 |
| 10.0 | 4.8 | 17.6 |
| 10.3 | 11.2 | 22.0 |
| 10.65 | 16.0 | 23.8 |
| 11.2 | 20.0 | 27.8 |

The improved effects of the compositions having pH within the range of the invention are evident.

EXAMPLE VII

The following particulate detergent compositions were prepared:

| Composition | % by weight |
|---|---|
| $C_{13}$—$C_{15}$ alcohol/7 ethylene oxide | 15.0 |
| Sodium triphosphate | 20.0 |
| Sodium pyrophosphate | 5.0 |
| Sodium perborate | 25.0 |
| Manganese sulphate (as $Mn^{2+}$) | 0.04 |

Alkaline metal sodium sulphate moisture up to 100%.

The amount of alkaline material in this powder was varied to give a pH (at 5 g/l dosage) varying from 9.5 to 11.5; the compositions were then tested at a dosage of 5 g/l in a 30 minutes' isothermal wash at 40° C. and water of 0° hardness (demineralized water).

The bleaching results obtained on standard tea-stained test cloths, measured as reflectance value (ΔR), are shown in Table 6 below.

A composition without manganese was used as control and comparison.

TABLE 6

| pH | ΔR − Mn | ΔR + Mn |
|---|---|---|
| 9.5 | 2.0 | 5.0 |
| 10.5 | 3.0 | 5.2 |
| 10.5 | 8.0 | 12.5 |
| 11.0 | 13.0 | 17.5 |
| 11.5 | 17.5 | 20.0 |

I claim:

1. Alkaline built detergent bleach composition comprising:

(a) from 2 to 50% by weight of a surface active agent, selected from the group consisting of anionic, non-ionic, zwitterionic and cationic detergents and mixtures thereof;

(b) from 5 to 50% by weight of a peroxide compound bleach, which liberates hydrogen peroxide in aqueous solution:

(c) a manganese compound which delivers manganese (II) ions in aqueous solution in an amount from 0.002 to 2.5% by weight of manganese (II); and (d) from 5 to 80% by weight of a detergency builder composition comprising:

(i) a mixture of a water-soluble, non-phosphorus organic sequestering builder and an alkaline buffer, selected from the group consisting of alkali metal orthophosphates, alkali metal silicates and alkali metal borates and mixtures thereof, in a weight ratio of organic sequestering builder to alkaline buffer of from 10:1 to 1:60; or (ii) a mixture of an alkali metal triphosphate and an alkali metal pyrophosphate, the latter being present in at least 5% by weight of the former, but not more than 15% by weight of the total composition;

said composition having a pH under use conditions of 9.5 to 12.0.

2. Detergent bleach composition according to claim 1, wherein said organic sequestering builder is selected from sodium citrates, sodium nitrilotriacetates, sodium oxydisuccinates, sodium mellitates, polyacetal carboxylate and polycarboxylate builders.

3. Detergent bleach composition according to claim 1, wherein said weight ratio of organic sequestering builder to alkaline buffer is from 5:1 to 1:30.

4. Detergent bleach composition according to claim 3, wherein said weight ratio is from 1:1 to 1:30.

5. Detergent bleach composition according to claim 1, wherein said alkali metal pyrophosphate is present in an amount of more than 20% by weight of said sodium triphosphate, but not more than 10% by weight of the total composition.

* * * * *